United States Patent [19]

Beaver et al.

[11] Patent Number: 4,760,041

[45] Date of Patent: Jul. 26, 1988

[54] PREPARATION AND USE OF ELECTRODES

[75] Inventors: R. Neal Beaver; Lloyd E. Alexander, both of Angleton; Carl E. Byrd, Richwood, all of Tex.

[73] Assignee: The Dow Chemical Company, Midland, Mich.

[21] Appl. No.: 68,773

[22] Filed: Jun. 26, 1987

Related U.S. Application Data

[63] Continuation of Ser. No. 848,516, Apr. 7, 1986, abandoned, which is a continuation of Ser. No. 499,626, May 31, 1983, abandoned.

[51] Int. Cl.[4] ..... H01M 4/88

[52] U.S. Cl. ..... 502/101; 204/290 R; 204/292

[58] Field of Search ..... 204/290 R, 292; 427/126.5, 126.6, 380, 438; 502/101

[56] References Cited

U.S. PATENT DOCUMENTS

| | | | |
|---|---|---|---|
| 4,336,282 | 6/1982 | Sato et al. | 427/125 |
| 4,358,475 | 11/1982 | Brown et al. | 204/290 R |
| 4,395,436 | 7/1983 | Bianchi et al. | 204/290 R |
| 4,414,064 | 11/1983 | Stachurski et al. | 204/290 R |
| 4,465,580 | 8/1984 | Kasuya | 204/290 R |

*Primary Examiner*—John F. Niebling
*Assistant Examiner*—Kathryn Rubino
*Attorney, Agent, or Firm*—W. J. Lee

[57] ABSTRACT

A substrate is coated with a solution of metal oxide precursor compounds and an etchant for etching the substrate, the metal oxide precursor compounds are thermally concentrated by removing volatiles therefrom, and the so-concentrated metal oxides precursors are thermally oxidized in-situ on the substrate. The so-formed compositions are useful, e.g., as electrode material in electrochemical apparatuses and processes.

28 Claims, 1 Drawing Sheet

PREPARATION AND USE OF ELECTRODES

This is a continuation of application Ser. No. 848,516 filed Apr. 7, 1986, now abandoned, which is a continuation of application Ser. No. 499,626 filed May 31, 1983, now abandoned.

BACKGROUND OF THE INVENTION

This invention pertains to a method for preparing electrodes and to their use in electrolytic cells, for example, brine electrolysis cells.

There are three general types of electrolytic cells used for the production of chlor-alkali: (1) the mercury cell, (2) the diaphragm cell, and (3) the membrane cell. The operation of each of these cells is discussed in Volume 1 of the Third Edition of the KIRK-OTHMER ENCYCLOPEDIA OF CHEMICAL TECHNOLOGY, page 799 et. seq. Other electrolytic cells which employ electrodes for electrolysis of aqueous solutions are the so-called "chlorate cells" which do not use a divider or separator between the cathodes and anodes. In the mercury cell, the alkali metal values produced by electrolyzing an alkali metal salt form an amalgam with the mercury; the amalgam, when reacted with water, produces NaOH and frees the mercury which can be recovered and cycled back for further use as a liquid cathode.

In many chlor-alkali electrolytic processes a brine solution (electrolyte) is electrolyzed by passing electric current therethrough in a cell having a diaphragm separator means or a membrane separator means positioned between the cathode means and the anode means. Chlorine is produced at the anode means while sodium hydroxide (NaOH) and hydrogen ($H_2$) are formed at the cathode means. Brine is fed continuously to the cells, while $Cl_2$, NaOH and $H_2$ are continuously withdrawn from the cells.

The minimum voltage required to electrolyze an electrolyte into $Cl_2$, NaOH and $H_2$ may be calculated using the thermodynamic data. However, in commercial practice, the theoretical amount of voltage is not achievable and higher voltages must be used to overcome the various resistances inherent in the various types of cells. To increase the efficiency of the operation of a diaphragm or a membrane cell one may attempt to reduce the overvoltages of the eleotrodes, to reduce the electrical resistance of the diaphragm or membrane, or reduce the electrical resistance of the brine being electrolyzed. The invention herein described results in an electrode particularly useful as a cathode in the electrolysis of brine; cathode overvoltage is substantially reduced, resulting in increased power efficiencies.

Because of the multi-million-ton quantity of alkali metal halides and water electrolyzed each year, even a reduction of as little as 0.05 volts in working voltage translates to very meaningful energy savings. Consequently, the industry has sought means to reduce the voltage requirement.

Throughout the development of chlor-alkali technology, various methods have been developed to reduce the cell voltage. Some practitioners have concentrated on reducing cell voltage by modifying the physical design of the electrolytic cell, while others have concentrated their efforts on reducing the overvoltage at the anode or the cathode. The present disclosure pertains, in part, to a novel process to make an electrode that is characterized by a significantly low overvoltage and to the use of these electrodes in electrolytic cells.

It has been disclosed that an electrode's overvoltage is a function of the current density and its composition (reference: PHYSICAL CHEMISTRY, 3rd ed., W. J. Moore, Prentice Hall (1962), pp. 406–408), where the current density refers to the amperage applied per unit of true surface area of an electrode and composition refers to the chemical and physical makeup of the electrode. Therefore, a process that will increase an electrode's surface area should decrease its overvoltage at a given apparent current density. It is also desirable to use a composition of matter that is a good electrocatalyst; this further reduces the overvoltage.

It is well known in the art to use plasma or flame spraying to coat an electrode with an electroconductive metal. In U.S. Pat. No. 1,263,959 it was taught that anodes may be coated by spraying fine nickel particles onto an anode, wherein the particles are rendered molten and impacted on the iron substrate by means of a blast.

Cathodes, also, have been coated with electroconductive metals. In U.S. Pat. No. 3,992,278, cathodes were coated by plasma spraying or flame spraying an admixture of particulate cobalt and particulate zirconia. When these electrodes are used for the electrolysis of water or an aqueous alkali metal halide salt solution, they are said to give prolonged lowering of hydrogen overvoltage.

Various metals and combinations of metals have been used to coat electrodes by plasma or flame spraying: U.S. Pat. No. 3,630,770 teaches the use of lanthanum boride; U.S. Pat. No. 3,649,355 teaches the use of tungsten or tungsten alloy; U.S. Pat. No. 3,788,968 teaches the use of titanium carbide or titanium nitride and at least one metal and/or metal oxide of the platinum group and a second oxide coating which is porous; U.S. Pat. No. 3,945,907 teaches the use of rhenium; and U.S. Pat. No. 3,974,058 teaches the use of cobalt as a coating with an overcoat of ruthenium.

It is, likewise, well known in the art to make porous electrode coatings by selective leaching. Coating an electrode with particulate nickel, then sintering the nickel as taught in U.S. Pat. Nos. 2,928,783 and 2,969,315; electrodepositing an alloy onto a substrate then leaching out one component of the alloy as taught in U.S. Pat. No. 3,272,788; pressing or cementing two or more components together or onto an electrode substrate and then selectively leaching out one or more of the coating components as illustrated by U.S. Pat. Nos. 3,316,159; 3,326,725; 3,427,204; 3,713,891 and 3,802,878.

It is also disclosed in the art to combine the steps of making electrodes by plasma- or flame-spraying followed by leaching. It is also disclosed to combine the steps of electroplating followed by leaching. Examples of known methods are illustrated in the following patents; U.S. Pat. No. 3,219,730 teaches coating a substrate with a multiple oxide film coating then removing the substrate by leaching, thus forming an electrode; U.S. Pat. No. 3,403,057 teaches flame or plasma spraying a Raney alloy onto a substrate followed by leaching aluminum out of the alloy thus leaving a porous electrode; U.S. Pat. No. 3,492,720 teaches plasma spraying tungsten, titanium or alloys thereof along with aluminum, thorium and zirconium oxides onto a substrate. The substrate was subsequently removed, leaving a porous electrode.

U.S. Pat. No. 3,497,425 teaches preparing porous electrodes by coating the substrate with a relatively insoluble metal followed by a coating of a more easily dissolvable metal. The teaching requires heat treating to cause inter-diffusion of the two coats, while optimum conditions require separate heat treatments for each coat. The dissolvable metal is subsequently leached out, leaving a porous electrode. U.S. Pat. No. 3,618,136 teaches forming porous electrodes by coating a binary salt composition onto a substrate and leaching a soluble component from the system. The patent teaches that it is critical that the binary salt mixture is a eutectic composition and that optimum results are obtained when the same anions are used for both the active and the inactive salts, e.g. silver chloride—sodium chloride.

Netherlands Patent Application No. 75-07550 teaches the preparation of porous cathodes by applying to a substrate a coating of at least one non-noble metal from the group of nickel, cobalt, chromium, manganese and iron, alloyed with a secondary, less noble, sacrificial metal followed by removal of at least a part of this sacrificial metal. Specifically, the sacrificial metal is chosen from the group of zinc, aluminum, magnesium and tin. The sacrificial metal is removed by leaching with a lye solution or an acid solution.

Japanese Pat. No. 31-6611 teaches forming a porous electrode by electroplating onto a substrate a nickel coating followed by a coating of zinc or some other soluble substance which is soluble in an alkaline solution. These coated electrodes are then either immersed in an alkaline solution or subjected to an electrochemical anodizing treatment to elute and remove zinc and other soluble substances, thus forming a porous electrode. Prior to immersion, a heat treatment of the coated electrode is required in some embodiments.

U.S. Pat. No. 4,279,709 discloses a method for making electrodes including electrodes having reduced overvoltage by applying an admixture of particulate metal and a particulate inorganic oompound pore-former and then leaching out the pore-former to form pores.

Electrodes of film-forming metal substrates, especially titanium, coated with oxides of Group VIII metals of the Periodic Table of The Elements have been taught, especially conjointly with other metal oxides, as being useful as anodes in electrolytic processes, such as in brine electrolysis. Ruthenium oxides, platinum oxides, and other oxides of the "platinum metal series", in association with various other metal oxides have received much acclaim as coatings for valve metal substrates (esp. Ti) for use as anodes. Patents relating to such anodes are, e.g. U.S. Pat. Nos. 3,632,498 and 3,711,385. These coatings may be applied in several ways, for example, U.S. Pat. No. 3,869,312 teaches that platinum group metal oxides, combined with film-forming metal oxides may be deposited on valve metal substrates by applying a mixture of thermally-decomposable compounds of platinum group metals and a thermally-decomposable organo-compound of a film-forming metal in an organic liquid vehicle which may also optionally contain a reducing agent, to a support member, drying the coating by evaporation of the organic vehicle, then heating the member in the range of 400°-550° C. to form metal oxides. Repeated coats are applied to increase the thickness of the coating. Also an overcoating of a film-forming metal oxide is applied. U.S. Pat. No. 3,632,498 teaches that coatings of finely divided oxides of platinum group metals and film-forming metals may be produced by use of a plasma burner, by heating substrates which have been coated with thermally-decomposable compounds of platinum group metals and film-forming metals, by electrically depositing the metals in a galvanic bath followed by heating in air to form the oxide, among others.

Some further patents relating to electrodes having metal oxide surfaces are, e.g., U.S. Pat. Nos. 3,616,445; 4,003,817; 4,072,585; 3,977,958; 4,061,549; 4,073,873; and 4,142,005.

The use of platinum group metal oxides, particularly ruthenium oxide, in active coatings for the evolution of hydrogen is also known (ref. Melendres, Carlos A., SPRING MEETING ELECTROCHEM. SOC., May 11-16, 1975). Japanese patent publication No. 9130/65, application (OPI) Nos. 131474/76 and 11178/77 refer to the use of a mixture of platinum group metal oxide(s) with another metal oxide as active cathode coatings. U.S. Pat. No. 4,238,311 teaches that a cathode coating consisting of fine particles of platinum group metals and/or platinum group metal oxides in nickel is useful as a cathode coating.

In general, it is known by those skilled in the art that the use of oxides of platinum group metals as active catalysts for the evolution of hydrogen in modern electrolytic chlor-alkali cells employing permionic membranes is not useful because of extreme conditions of NaOH concentration and temperature now possible, wherein NaOH concentrations of 30% and temperatures exceeding 95° C. are not uncommon. Oxide coatings prepared according to the known art are found to decrepitate with use and fail by loss of adherence to the substrate, accompanied presumably by substantial reduction, in some cases, to base metals.

It is also well known to those practiced in the art that catalytic coatings consisting of metals with intrinsically low hydrogen overvoltage properties are subject in actual practice to loss of catalytic activity due to overplating with metallic contaminants, such as iron for example, which are commonly present in brine and water employed in the process of electrolysis. Consequently, active coatings found useful by those practiced in the art for evolution of hydrogen in modern electrolytic membrane chlor-alkali cells are limited to the type characterized by high surface area, or porous coatings, with compositions resistant to some degree to chemical attack at these conditions, e.g. nickel or various stainless steels.

In these cases, the full effect of the catalytic nature of intrinsically low hydrogen overvoltage catalysts are not realized in practice, since, as is well known to those practiced in the art, the performance of these essentially high surface area coatings degrades in time to a level characterized by the equivalent coating of the predominant metallic contaminant present in the brine or water employed in the electrolytic process, usually Fe. Consequently, the Tafel slope characterizing the electrolytic activity of the applied coating changes to essentially that of iron, with a resulting increase in hydrogen overvoltage, especially at higher current densities, i.e. 1.5 to 3.5 amps per square inch and above, as are common in modern membrane chlor-alkali cells. In contrast, it is desirable to maintain the intrinsically low overvoltage properties of those materials which are known to be characterized by low Tafel slopes, i.e. platinum group metal oxides, particularly ruthenium oxide, during long-term operation in membrane chlor-alkali cells. It has now been discovered, among other things, that active coatings of oxides of platinum group metals and secondary electrocatalytic metals may be prepared which, when prepared according to the process of the invention, exhibit unexpected properties of low hydrogen overvoltage, physical stability, and long-term efficacy as cathodes in the electrolysis of brine at conditions of high NaOH concentrations, temperatures, and process pressures. It has also been discovered that the use of these electrodes in electrolytic processes wherein chlorine and caustic soda are produced at certain process conditions of temperature, NaOH concentration, pressure, etc., results in reduced energy requirements not otherwise attainable in practice.

SUMMARY OF THE INVENTION

Electrodes comprising a substrate having an electrocatalytically-active coating of metal oxides are prepared by applying soluble metal compounds to the substrate, along with a chemical etchant capable of etching the substrate and/or the previously applied coatings, thereafter the substrate is heated to concentrate and volatize the etchant and progressively deposit and redeposit the dissolved and redissolved metal compounds, and convert them to oxides in an oxidizing environment. The electrodes are employed in electrolytic cells and processes.

DETAILED DESCRIPTION

Figure 1:
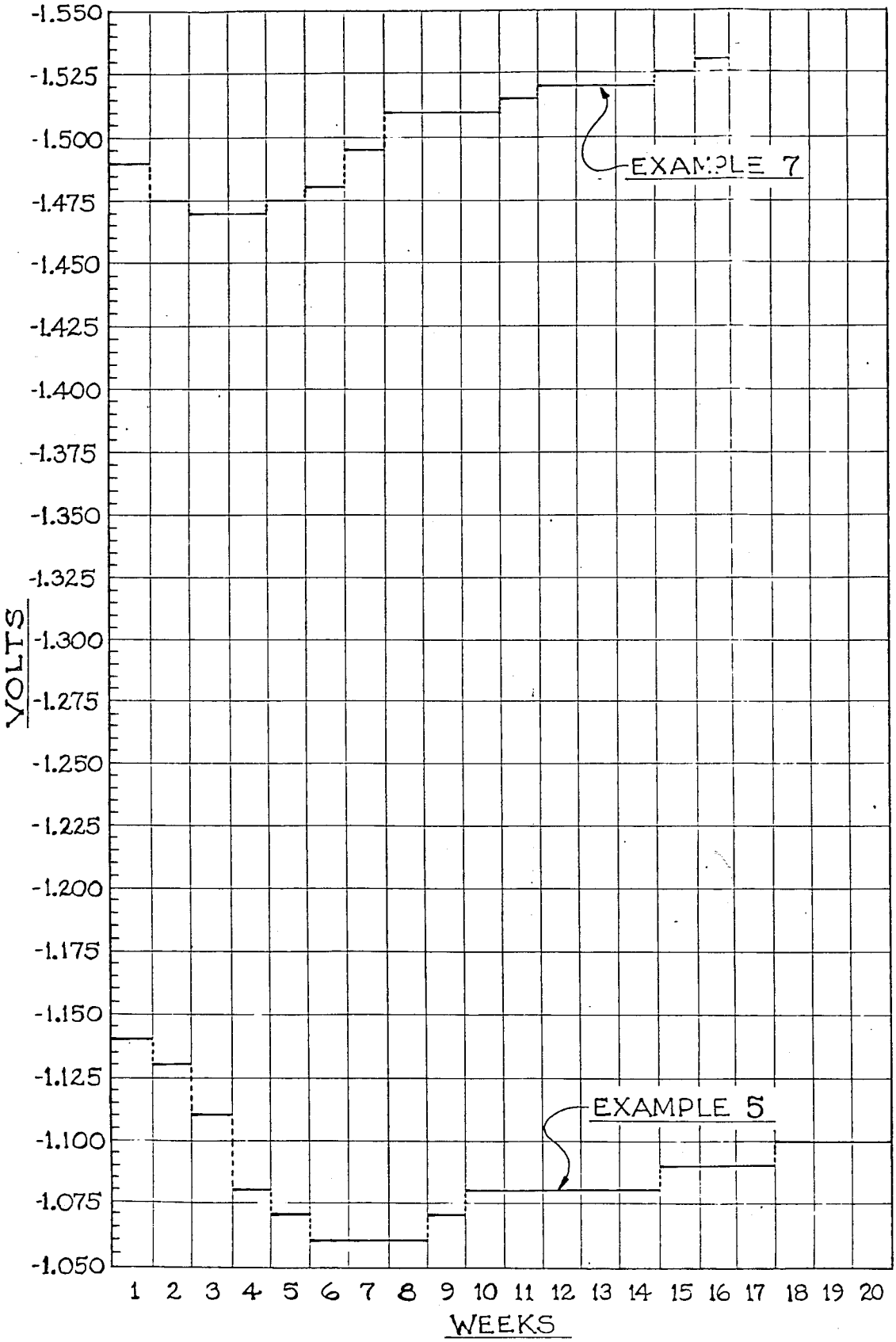
Figure 1:
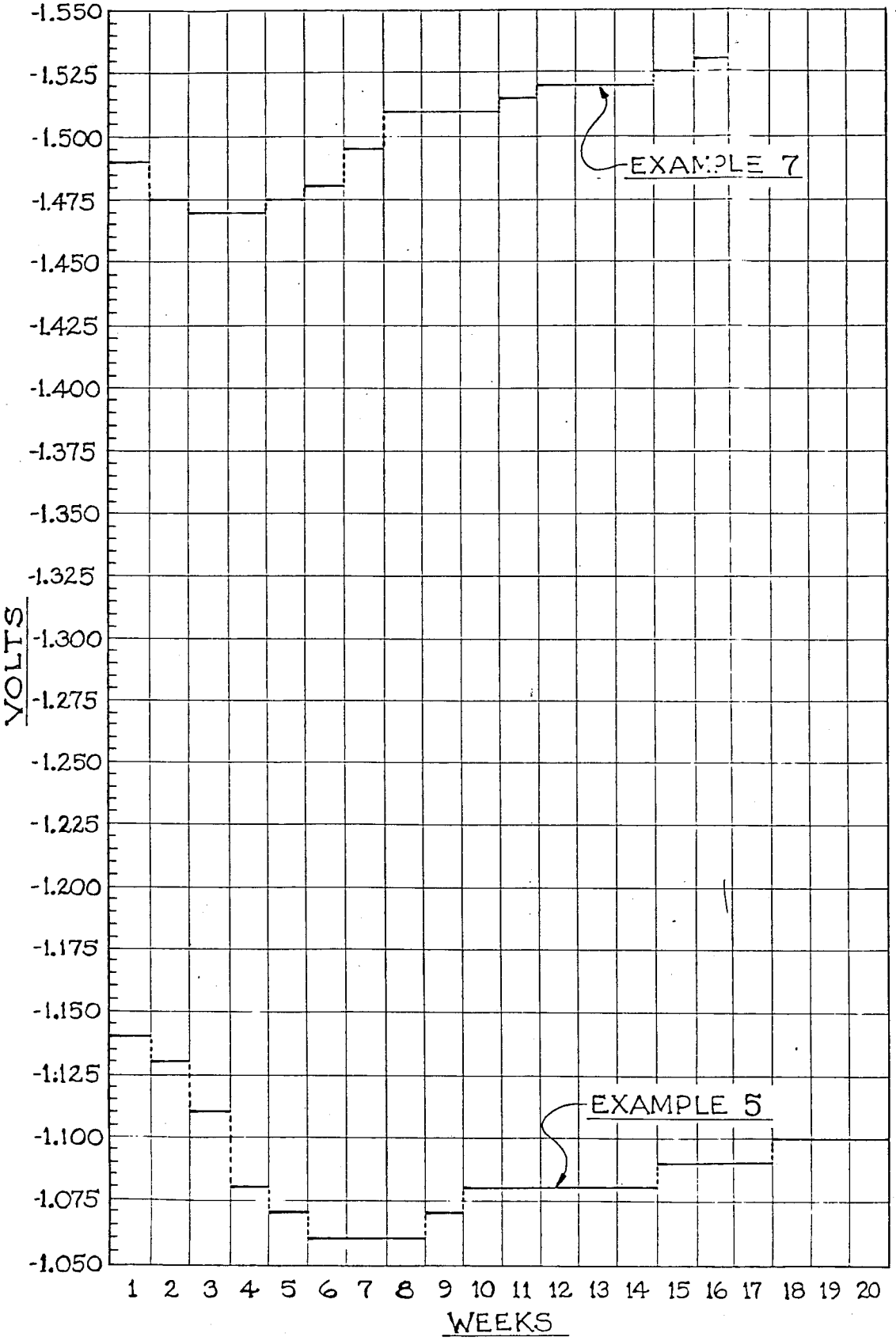

FIG. 1 is provided herewith showing graphed data from some of the tests described hereinafter.

Electrodes comprising an electrically conductive, or non-conductive substrate having a coating of heterogeneous oxide mixtures of platinum group metals and secondary electrocatalytic metals are prepared by applying soluble metal compounds and an etchant for the substrate, and, in cases of successive coats, etching the metal oxides previously applied to the substrate, thereby, it is believed, attacking and solubilizing the least chemically resistant portions of the coating, then, as the substrate is heated to oxidize the metal values, concentrating and redepositing the said metal values on the substrate, and oxidizing them to produce a substantially hard, stable mixture of heterogeneous oxides of the metal values.

The preferred electrically-conductive substrate may be any metal structure which retains its physical integrity during the preparation of the electrode. Metal laminates may be used, such as a ferrous metal coated with another metal, e.g., nickel or a film-forming metal (also known as valve metal). The substrate may be a ferrous metal, such as iron, steel, stainless steel or other metal alloys wherein the major component is iron. The substrate may also be a non-ferrous metal, such as a film-forming metal or a non-film-forming metal, e.g., Ni. Film-forming metals are well known in these relevant arts as including, notably, titanium, tantalum, zirconium, niobium, tungsten and alloys of these with each other and with minor amounts of other metals. Non-conductive substrates may be employed, especially if they are then coated with a conductive layer onto which the instant metal oxides are deposited.

The shape or configuration of the substrate used in the present coating process may be a flat sheet, curved surface, convoluted surface, punched plate, woven wire, expanded metal sheet, rod, tube, porous, non-porous, sintered, filamentary, regular, or irregular. The present novel coating process is not dependent on having a substrate of a particular shape, since the chemical and thermal steps involved are applicable to virtually any shape which could be useful as an electrode article. Many electrolytic cells contain foraminous (mesh) sheets or flat plate sheets; these are sometimes bent to form "pocket" electrodes with substantially parallel sides in a spaced-apart relationship.

The preferred substrate configuration comprises expanded mesh, punched plate, woven wire, sintered metal, plate, or sheet, with expanded mesh being one of the most preferred of the porous substrates.

The preferred composition of the substrate comprises nickel, iron, copper, steel, stainless steel, or ferrous metal laminated with nickel, with nickel being especially preferred. It will be understood that these substrates, onto which the metal oxide coatings are to be deposited, may themselves be supported or reinforced by an underlying substrate or member, especially where nickel, iron, or copper is carried by, or on, an underlying substrate or member. The substrate, onto which the metal oxide coating is to be deposited, may itself be an outer layer of a laminate or coated structure, and it may be, optionally, a non-conductive substrate onto which the metal oxide coating is deposited.

The platinum metal series comprises Ru, Rh, Pd, Os, Ir, and Pt. Of these, the preferred metals are platinum and ruthenium, with ruthenium being most preferred. The soluble platinum metal compound may be the halide, sulphate, nitrate or other soluble salt or soluble compound of the metal and is preferably the halide salt, such as $RuCl_3$.hydrate, $PtCl_4$.hydrate, and the like.

The secondary electrocatalytic metal oxide precursor of the present coating may be at least one derived from a soluble compound of Ni, Co, Fe, Cu, W, V, Mn, Mo, Nb, Ta, Ti, Zr, Cd, Cr, B, Sn, La, or Si. The preferred of these are Ni, Zr, and Ti, with Ni being the most preferred.

The solution of the present invention contains at least one chemically active agent capable of etching the substrate, and, in the case of second and later coatings, etching and solubilizing the most chemically-susceptible portions of the oxides previously formed, while also, preferably as the temperature is elevated, vaporizing, in many cases, from the heated mixture, along with volatilized anions or negative-valence radicals from the platinum metal oxide precursor and the secondary electrocatalytic metal oxide precursor. The preferred chemically active etchants comprise most common acids, such as hydrochloric acid, sulphuric acid, nitric acid, phosphoric acid; also hydrazine hydrosulphate, and the like, with hydrochloric acid and hydrazine hydrosulphate being among the most preferred.

In general, the preferred method contemplated in the present invention comprises applying to the desired substrate a solution containing at least one platinum metal series compound, at least one electrocatalytic metal compound, and a chemical etchant, preferably containing a volatile organic vehicle, such as isopropanol, and allowing the volatile vehicle to evaporate, leaving the etchant and the dissolved metal values; then heating the substrate to a temperature sufficient to concentrate the metal values, also substantially driving out the volatilized etchant along with the anions or negative-valence radicals released from the metal oxide precursors, and heating the substrate in the presence of oxygen or air to a temperature sufficient to thermally oxidize and convert the metals to metal oxides in-situ on the substrate. The steps may be repeated a plurality of times in order to attain the best full effect of the invention by increasing the thickness of the coating. Furthermore there is, at times, a benefit to be derived from laying down 2 or more layers of the metal oxide precursors between each thermal oxidation step.

In a particularly preferred embodiment an electrode material is prepared by applying a heterogeneous metal oxide coating, said heterogeneous metal oxide coating comprising nickel oxide and a platinum group metal oxide (optionally containing a modifier metal oxide, e.g., $ZrO_2$, onto a nickel metal layer (which may be in the form of a nickel layer on an electroconductive substrate) by the process which comprises (a) applying to said nickel metal layer a coating solution comprising a nickel oxide precursor, a platinum group metal oxide precursor, an optional modifier metal oxide precursor, and an etchant for dissolving the most soluble portions of the nickel metal surface, (b) heating to evaporate volatile portions of the coating solution, thereby concentrating and depositing the metal oxide precursors on the so-etched nickel metal surface, (c) heating in the presence of air or oxygen at a temperature between about 300° C. to about 600° C. for a time sufficient to oxidize the metals of the metal oxide precursors, and (d) cooling the so-prepared electrode material. Additional coatings may be applied in similar manner so as to increase the thickness of the so-produced heterogeneous metal oxide coating on the nickel metal surface, though the etchant for the second and later coating applications may beneficially be the same as, or different from, the etchant used in the initial coating application. There is thus prepared an electrode material comprising a nickel metal layer having tightly adhered thereto a heterogeneous metal oxide coating, said heterogeneous metal oxide coating comprising nickel oxide and a platinum group metal oxide, optionally also containing a modifier metal oxide. Preferably, the platinum group metal oxide is ruthenium oxide. The preferred optional modifier metal oxide is zirconium oxide. An economical form of the nickel metal layer is that of a nickel layer on a less expensive electroconductive substrate, such as steel or iron alloys. Such electrode material is particularly useful as cathodes in chlor-alkali cells.

Ordinarily the temperatures at which thermal oxidation of the metals is achieved is somewhat dependent on the metals, but a temperature in the range of about 300° to 650° C., more or less, is generally effective. It is generally preferred that the thermal oxidation be performed at a temperature in the range of about 350° to 550° C.

The effect of the invention is to produce a substantially hard, adherent coating of heterogeneous oxides of the solubilized metals.

It is within the purview of the present inventive concept that the solubilization, reconcentration, and in-situ deposition of the solubilized metals, using chemical etching of the previously deposited layers and/or substrate produces an intimate mixture of oxides which are mutually stabilizing and electrocatalytically complementary.

The following examples illustrate particular embodiments, but the invention is not limited to the particular embodiments illustrated.

EXAMPLE 1

A solution was prepared which consisted of 1 part $RuCl_3.3H_2O$, 1 part $NiCl_2.6H_2O$, 3.3 parts $H_2NNH_2.H_2SO_4$ (hydrazine hydrosulphate), 5 parts $H_2O$, and 28 parts isopropanol. The solution was prepared by first mixing together all ingredients other than the isopropanol by stirring overnight, then adding the isopropanol and continuing to stir for approximately 6 hours.

A cathode was prepared which was constructed of a 40% expanded mesh of nickel. The cathode was first sandblasted, then etched in 1:1 HCl. It was subsequently rinsed, dipped in isopropanol and air dried. The cathode was coated by dipping it into the coating solution, allowing it to air dry, then baking it in an oven at 375° C. for 20 minutes. In the same manner, a total of 6 coats were applied. The cathode was immersed in a heated bath containing 35% NaOH at a temperature of 90° C. A current was applied and potential measurements were taken using a standard Calomel Reference Electrode (SCE) and a Luggin probe. The cathode potential was measured at −1145millivolts vs. SCE at a current density of 2 amps per square inch (0.31 amps per $cm^2$). The cathode was assembled in a laboratory membrane chlorine cell and operated at 90° C., producing $Cl_2$ at the anode and $H_2$ at the cathode, at 31–33% NaOH concentration, operating at 2 amps per square inch current density. The potential of the cathode was monitored and averaged per week. The results are shown in Table I.

EXAMPLE 2

A solution was prepared which consisted of 1 part $RuCl_3.3H_2O$, 1 part $NiCl_2.6H_2O$, and 3.3 parts concentrated HCl. It was allowed to mix overnight. Subsequently, 33 parts isopropanol were added and mixing continued 2 hours. A cathode was prepared in accordance with the procedure of Example 1. The cathode was then coated in the same manner as Example 1 except baking was at 495°–500° C. Ten coats were applied. The cathode potential was measured as in Example 1. The potential was −1135 millivolts vs. SCE. The cathode was assembled in a laboratory membrane chlorine cell containing a commercially available NAFION* polymer (*a tradename of E. I. duPont de Nemours). The cell was operated at 90° C., 31–33% NaOH, and 2 amps per square inch current density. The potential of the cathode was monitored and averaged per week. The results are shown in Table I.

EXAMPLE 3

A solution was prepared which consisted of 1 part $NH_2OH.HCl$, 5 parts concentrated HCl, 2 parts 10% $H_2PtCl_6.6H_2O$, 1 part $NiCl_2.6H_2O$, and 1 part $RuCl_3.3H_2O$. The solution was allowed to mix for 12 hours. Then 75 parts isopropanol were added and mixing continued for 2 hours. A cathode was prepared according to Example 1. The cathode was then coated in the same manner as Example 1 except baking was at 470°–480° C. Five coats were applied. A sixth coat was applied and the electrode was baked for 30 minutes at 470°–480° C. The potential of the cathode was measured as in Example 1. The potential was −1108 millivolts vs. SCE. The cathode was assembled in a laboratory membrane chlorine cell containing a commercialy available membrane, as in Example 2. The cell was operated at 90° C., 31–33% NaOH, and 2 amps per square inch current density. The potential of the cathode was monitored and averaged per week. The results are shown in Table I.

EXAMPLE 4

A solution was prepared which consisted of 3 parts $RuCl_3.3H_2O$, 3 parts $NiCl_2.6H_2O$, 1 part $ZrCl_4$, 5 parts concentrated HCl, and 42 parts isopropanol. The solution was allowed to mix 2 hours. The cathode was then coated in the same manner as Example 1 except baking was at 495°-500° C. Eight coats were applied. A ninth coat was applied and the electrode was baked for 30 minutes at 470°-480° C. The potential of the cathode was measured as in Example 1. The potential was −1146 millivolts vs. SCE. The cathode was assembled in a laboratory membrane chlorine cell containing a commercially available membrane, as in Example 2. The cell was operated at 90° C., 31-33% NaOH, and 2 amps per square inch current density. The potential of the cathode was monitored and averaged per week. The results are shown in Table I.

EXAMPLE 5

A cathode was prepared as in the previous examples, then dipped in a solution containing 1 gram of tetraisopropyl titanate in 100 ml of isopropanol. The cathode was then baked at 475°-500° C. for 10 minutes. Three coats were applied. A solution was prepared as in Example 2. The cathode was dipped in the solution, air dried, and baked at 475°-500° C. Six coats were applied. The potential of the cathode was measured as in the previous examples. The potential was −1154 millivolts vs. SCE. The cathode was assembled in a laboratory membrane chlorine cell containing a commercially available membrane, as in Example 2. The cell was operated at 90° C., 31-33% NaOH, and 2 amps per square inch current density. The potential of the cathode was monitored and averaged per week. The results are shown in Table I and also in FIG. 1.

EXAMPLE 6

(Comparative Example)

A 40% expanded mesh electrode of steel was prepared, but not coated, and assembled as the cathode in a laboratory cell as in Examples 2-5, using the same type membrane. The potential of the cathode was monitored and averaged per week. The results are shown in Table I.

EXAMPLE 7

(Comparative Example)

A 40% expanded mesh electrode of nickel was prepared, but not coated, and assembled as the cathode in a laboratory cell as in Examples 2-5, using the same type membrane. The potential of the cathode was monitored and averaged per week. The results are shown in Table I and also in FIG. 1.

TABLE I

| No. of Weeks | Negative voltage* averaged each week for Electrodes No. 1 thru 7 | | | | | | |
|---|---|---|---|---|---|---|---|
| | Ex. 1 | Ex. 2 | Ex. 3 | Ex. 4 | Ex. 5 | Ex. 6 | Ex. 7 |
| 1 | 1.145 | 1.120 | 1.135 | 1.120 | 1.140 | 1.475 | 1.490 |
| 2 | 1.150 | 1.120 | 1.150 | 1.130 | 1.130 | 1.460 | 1.475 |
| 3 | 1.150 | 1.125 | 1.160 | 1.150 | 1.110 | 1.455 | 1.470 |
| 4 | 1.155 | 1.130 | 1.150 | 1.155 | 1.080 | 1.455 | 1.470 |
| 5 | 1.155 | 1.130 | 1.150 | 1.150 | 1.070 | 1.465 | 1.475 |
| 6 | 1.150 | 1.130 | 1.180 | 1.150 | 1.060 | 1.475 | 1.480 |
| 7 | 1.150 | 1.125 | 1.185 | 1.155 | 1.060 | 1.480 | 1.495 |
| 8 | 1.150 | 1.125 | 1.180 | 1.160 | 1.060 | 1.480 | 1.510 |
| 9 | 1.140 | 1.120 | 1.160 | 1.155 | 1.070 | 1.480 | 1.510 |
| 10 | 1.130 | 1.110 | 1.185 | 1.160 | 1.080 | 1.475 | 1.510 |

TABLE I-continued

| No. of Weeks | Negative voltage* averaged each week for Electrodes No. 1 thru 7 | | | | | | |
|---|---|---|---|---|---|---|---|
| | Ex. 1 | Ex. 2 | Ex. 3 | Ex. 4 | Ex. 5 | Ex. 6 | Ex. 7 |
| 11 | 1.115 | 1.115 | 1.190 | 1.170 | 1.080 | 1.480 | 1.515 |
| 12 | 1.100 | 1.110 | 1.190 | 1.165 | 1.080 | 1.490 | 1.520 |
| 13 | 1.100 | 1.110 | 1.190 | 1.165 | 1.080 | 1.485 | 1.520 |
| 14 | 1.100 | 1.115 | 1.190 | 1.170 | 1.080 | — | 1.520 |
| 15 | 1.095 | 1.120 | 1.190 | 1.170 | 1.090 | — | 1.525 |
| 16 | 1.090 | 1.120 | 1.190 | 1.170 | 1.090 | — | 1.530 |
| 17 | 1.085 | 1.120 | 1.190 | 1.170 | 1.090 | — | — |
| 18 | 1.080 | 1.120 | 1.190 | 1.165 | 1.100 | — | — |
| 19 | 1.080 | 1.110 | 1.190 | 1.160 | 1.100 | — | — |
| 20 | 1.080 | 1.110 | 1.190 | — | 1.100 | — | — |
| 21 | 1.080 | 1.110 | 1.190 | — | — | — | — |
| 22 | 1.090 | — | 1.190 | — | — | — | — |
| 23 | 1.090 | — | 1.190 | — | — | — | — |
| 24 | 1.100 | — | 1.190 | — | — | — | — |
| 25 | 1.100 | — | — | — | — | — | — |
| 26 | 1.090 | — | — | — | — | — | — |
| 27 | 1.090 | — | — | — | — | — | — |

*The voltages recorded in Table I were all measured in the same manner, using a Luggin probe, thus are relevant to each other, though all are believed to be slightly lower than what one should expect to find from a theoretical calculation. By thermodynamic calculations, the actual absolute reversible voltage should be about −1.093 V for a cell at 90° C., 31-33% NaOH, and at a current density of 2 amp./in$^2$.

EXAMPLE 8

The cells of Examples 2-7 were operated at 90° C., 31-33% NaOH, and 2 amps per square inch current density while maintaining atmospheric pressures in the anolyte and catholyte compartments of the cell. Sodium chloride brine and water were fed to the anolyte and catholyte compartments, respectively, in order to maintain anolyte concentrations in the range 180-200 grams per liter NaCl and 31-33% NaOH. Internal mixing of the cells was accomplished by natural gas lift due to evolution of hydrogen gas at the cathode and chlorine gas at the anode. Data including mass and energy balances were collected periodically over the period of operation of the cells and energy requirements for the production of NaOH were calculated. The results are shown in Table 2.

TABLE 2

| Electrode # | Cathode | KWH/MT NaOH |
|---|---|---|
| 2 | coated | 2208 |
| 3 | coated | 2221 |
| 4 | coated | 2229 |
| 5 | coated | 2259 |
| 6 | steel | 2497 |
| 7 | nickel | 2504 |

EXAMPLE 9

In a large scale test, two series of pressure membrane chlorine cells were constructed. The construction and design of the cells were identical except that the series identified as Series 1 had nickel-wall cathode compartment and nickel electrodes installed in the catholyte compartment of the cells, while the series identified as Series 2 was constructed of steel-wall cathode compartment and steel cathodes. The electrodes of Series 1 were coated according to the process of the invention, while those of Series 2 were uncoated. Both series were erected with a commercially available cation exchange membrane, as in Example 2. The two series were operated simultaneously at 90° C., 2 amps per square inch current density, and 31 to 33% sodium hydroxide in the catholyte chamber. The series were operated at pressures of 1 to 2 atmospheres while recirculating the anolyte and the catholyte through the cells using centrifugal pumps. The ratio of the catholyte flow to the anolyte flow was maintained at a value greater than 1. Energy and mass balance data were collected and average performance data were calculated over a period of 45 days. The results clearly show that the energy savings attained with the use of the electrodes of the present invention (Series 1) averaged greater than a 5% reduction in energy, compared with Series 2.

It is within the purview of the present invention to employ the present novel electrodes at temperatures encountered in cells operated at superatmospheric pressures, as well as at atmospheric or subatmospheric pressures. The electrodes are especially suitable for operation in the elevated temperature range of about 85° to about 105° C. Pressures at around 1 atm., more or less, are ordinarily used in chlor-alkali cells, though pressures up to about 3 atm. or more may be used.

The electrodes of the present invention are useful in cells wherein circulation within each electrolyte compartment is created by the gas-lift (displacement) action of gaseous products produced therein, though in some cells, such as in electrolyte series flow from cell-to-cell, another pumping means may be provided to supplement, or substitute for, the gas-lift action. We find it advisable, in some cases, to maintain the ratio of the volume of catholyte pumped to that of the anolyte volume pumped, at a ratio greater than unity.

The electrodes of this invention are useful in chlor-alkali electrolytic cells in which the anolyte has, or is adjusted to have, a pH in the range of about 1 to about 5, such as when an acid, e.g. HCl, is added to the anolyte.

What is claimed is:

1. A method for making a low hydrogen overvoltage cathode which comprises a substrate having coated thereon a cathodic layer, said substrate consisting of nickel metal and said cathodic layer consisting of an electrocatalytically-active heterogeneous mixture of nickel oxide and a platinum group metal oxide, said method consisting essentially of (a) depositing on the nickel metal substrate a coating solution of
  (1) a nickel compound which is effective as a precursor for the formation of nickel oxide by thermal oxidation thereof, and
  (2) at least one platinum group metal compound which is effective as a precursor for the formation of platinum group metal oxide by thermal oxidation thereof,
  (3) and, optionally, a small amount of a metal compound which is effective as a precursor for a modifier metal oxide by thermal oxidation thereof, said coating solution also containing an etchant capable of etching the surface onto which the coating solution is applied, (b) heating to remove volatiles from the so-coated substrate to cause the metal values of the precursor compounds and those etched from the said surface to be concentrated and recoated on the said surface, (c) and further heating, in the presence of oxygen, air or an oxidizing agent, to a temperature sufficient to oxidize all of the nickel compounds and platinum metal group compounds and any optional modifier metal compounds supplied as oxide precursors in the coating solution, said steps (a), (b), and (c) being performed a plurality of times.

2. The method of claim 1 wherein the coating solution contains a small amount of a metal compound which is effective as a precursor for a modifier metla oxide, by thermal oxidation thereof, for modifying the hetergeneous mixture of nickel oxide and platinum group metal oxide.

3. The method of claim 2 wherein the modifer metal oxide is zironium oxide.

4. The method of claim 1 wherein the platinum group metal comprises piatinum or ruthenium or both platinum and ruthenium.

5. The method of claim 1 wherein the platium group metal comprises ruthenium.

6. The method of claim 1 wherein the nickel substrate is supported by, carried by, or laminated to an underlying substrate or member.

7. The method of claim 1 wherein the nickel metal substrate is self-supporting.

8. The method of claim wherein the nickel metal substrate is supported by, carried by, or laminated to an electroconductive underlying substrate or member.

9. The method of claim 1 wherein the nickel metal substrate is supported by, carried by, or laminated to a non-electroconductive underlying substrate or member.

10. The method of claim 1 wherein the metal oxide preursor compounds are selected from the group consisting of chlorides, nitrates, sulphates, and phosphates.

11. The method of claim 1 wherein the etchant is at leat one selected from the group consisting of hydrochloric acid, sulphuric aicd, nitric acid, phosphoric acid, and hydrazine hydrosulphate.

12. The method of claim 1 wherein the temperature at which the oxidation of the metal values is carried out is in the range of from about 300° C. to about 600° C.

13. The method of claim 1 wherein the shape or configuration of the nickel metal substrate is a flat sheet, a curved surface, a convoluted surface, a punched plate, a woven wire, an expanded metal sheet, a rod, a tube, porous, non-porous, sintered, filamentary, regular, or irregular.

14. The method of claim 1 wherein the shape or configuration of the nickel metal substrate comprises an expanded mesh.

15. The method of claim 1 wherein the thermal oxidation is done at a temperature in the range of about 350° C. to about 550° C.

16. A method for making a low hydrogen overvoltage cathode which comprises a substrate having a coated thereon a cathodic layer, said substrate consisting of nickel metal and said layer consisting of a heterogeneous mixture of nickel oxide and ruthenium oxide along with a small amount of zirconium oxide as a modifier oxide, said method the steps of (a) depositing on the substrate a coating solution of (1) a nickel compound which is effective as a precursor for the formation of nickel oxide by thermal oxidation thereof, (2) a ruthenium compound which is effective as a precursor for the formation of ruthenium oxide by thermal oxidation thereof, and (3) a small modifying amount of a zirconium compound which is effective as a precursor for zirconium oxide by thermal oxidation thereof, said coating solution also contaning an etchant capable of etching the surface onto to which the coating is applied (b) heating to remove volatiles from the so-coated substrate to cause the metal values of the precursor compounds and those etched from the said surface to be concentrated and recoated on the said surface, (c) and further heating, in the presence of oxygen, air or an oxidizing agent, to temperature sufficent to oxidize all the metal values of the precursor compounds, said steps (a), (b), and (c) being performed a plurality of times.

17. The method of claim 16 wherein the thermal oxidation is done at a temperature in the range of about 300° C. to about 650° C.

18. The method of claim 16 wherein the thermal oxidation is done at a temperature in the range of about 300° C. to about 600° C.

19. The method of claim 16 wherein the thermal oxidation is done at a temperature in the range of about 350° C. to about 550° C.

20. The method of claim 16 wherein the said substrate comprises an expanded mesh.

21. The method of claim 16 wherein the said substrate comprises a woven wire.

22. The method of claim 16 wherein the said substrate is supported by, carried by, or laminated to an underlying substrate or member.

23. The method of claim 15 wherein the nickel metal substrate is self-supporting.

24. The method of claim 15 wherein the nickel metal substrate is supported by, carried by, or laminated to an electroconductive underlying substrate or member.

25. The method of claim 16 wherein the nickel metal substrate is supported by, carried by, or laminated to a non-electroconductive underlying substrate or member.

26. The method of claim 16 wherein the metal oxide percursor compounds are selected from the group consisting of chlorides, nitrates, sulphates, and phosphates.

27. The method of claim 16 wherein the etchant is at least one selected from the group consisting of hydrochloric acid, sulphuric acid, nitric acid, phosphoric acid, and hydrazine hydrosulphate.

28. The method of claim 16 wherein the shape or configuration of the nickel metal substrate is a flat sheet, a curved surface, a convoluted surface, a punched plate, a woven wire, an expanded metal sheet, a rod, a tube, porous, non-porous, sintered, filamentary, regular, or irregular.

* * * * *

UNITED STATES PATENT AND TRADEMARK OFFICE

CERTIFICATE OF CORRECTION

PATENT NO. : 4,760,041

DATED : July 26, 1988

INVENTOR(S) : R. Neal Beaver; Lloyd E. Alexander & Carl E. Byrd

It is certified that error appears in the above-identified patent and that said Letters Patent is hereby corrected as shown below:

Col. 1, line 47, "eleotrodes," should be --electrodes,--.

Col. 3, line 39, "oompound" should be --compound--.

Col. 12, line 5, "metla" should be --metal--.

Col. 12, line 14, "platium" should be --platinum--.

Col. 12, line 21, insert --1-- after "Claim".

Col. 12, line 28, "preursor" should be --precursor--.

Col. 12, line 32, "leat" should be --least--.

Col. 12, line 33, "aicd," should be --acid,--.

Col. 12, line 66, "contaning" should be --containing--.

Col. 14, line 4, "15" should be --16--.

Col. 14, line 6, "15" should be --16--.

Signed and Sealed this

Twenty-first Day of March, 1989

*Attest:*

DONALD J. QUIGG

*Attesting Officer*

*Commissioner of Patents and Trademarks*